US005428336A

United States Patent [19]

Smith et al.

[11] Patent Number: 5,428,336

[45] Date of Patent: Jun. 27, 1995

[54] ELECTRIC SWITCHES

[75] Inventors: David A. Smith; Andrew V. Florentine, both of Buxton, England

[73] Assignee: Otter Controls Limited, Derbyshire, England

[21] Appl. No.: 133,112

[22] PCT Filed: Apr. 30, 1992

[86] PCT No.: PCT/GB92/00793

§ 371 Date: Oct. 12, 1993

§ 102(e) Date: Oct. 12, 1993

[87] PCT Pub. No.: WO92/20086

PCT Pub. Date: Nov. 12, 1992

[30] Foreign Application Priority Data

Apr. 30, 1991 [GB] United Kingdom ..... 9109316

[51] Int. Cl.[6] ..... H01H 37/54

[52] U.S. Cl. ..... 337/365; 337/380; 337/89

[58] Field of Search ..... 337/365, 368, 372, 375, 337/380, 89, 112

[56] References Cited

U.S. PATENT DOCUMENTS

| | | | |
|---|---|---|---|
| 4,088,976 | 5/1978 | Bell | 337/365 |
| 4,507,642 | 3/1985 | Blackburn | 337/89 |
| 4,902,999 | 2/1990 | Ball, Jr. et al. | 337/372 |
| 5,014,034 | 5/1991 | Wehl | 337/368 |

*Primary Examiner*—Lincoln Donovan

*Attorney, Agent, or Firm*—Pollock, Vande Sande & Priddy

[57] ABSTRACT

A thermally-responsive switch, designed to go open circuit in response to relatively low overload currents of the order of 2 amps and below, comprises a moulded plastics body capturing therein first and second simple copper wire terminals and having an internal chamber wherein a snap-acting bimetal blade of very low thickness is spot-welded to one of the wire terminals and carries a silver contact which co-operates in switching operations with the other wire terminal, the internal construction of the switch body chamber being arranged to provide physical support to the bimetal blade by way of the respective one of the wire terminals to which the bimetal blade is secured.

20 Claims, 2 Drawing Sheets

ELECTRIC SWITCHES

FIELD OF THE INVENTION

This invention concerns improvements relating to electric switches and more particularly concerns thermally responsive electrical switches employing bimetallic elements as thermal actuators.

BACKGROUND OF THE INVENTION

Many kinds of electrical switches employing bimetallic actuators are known and likewise many different forms of bimetallic switch actuators are known. Early bimetallic switches simply employed a plain bimetal blade which moved relatively slowly in response to temperature changes and gave rise to arcing problems in the switch, and the development of the snap-acting bimetallic actuator, constructed as a dished bimetallic element capable of moving between oppositely curved configurations with a snap-action, provided a major advance in the art. Various forms of snap-acting bimetallic actuators are known, such as those disclosed in GB 600055, GB 657434, GB 1064643, GB 1542252 and GB 2124429 for example, and various forms of electric switches employing such bimetallic actuators are likewise known; GB 2124429 abovementioned for example discloses the utilization of a pear-shaped snap-acting bimetallic actuator in a current-sensitive switch where the heating of the bimetal by electric current flow therethrough is designed to trip the switch in a current overload situation.

OBJECTS AND SUMMARY OF THE INVENTION

The object of the present invention is to provide a thermally responsive switch incorporating a bimetallic switch actuator and capable of response to very small through currents, the switch being of inexpensive and uncomplicated construction.

According to the present invention there is provided a thermally-responsive switch comprising a moulded plastics body portion capturing therein first and second terminal conductors, and a snap-acting bimetallic actuator secured to one of said conductors and carrying a contact which constitutes the moving contact of the switch and is arranged for co-operation in switching operations with the other of the two conductors, characterized in that the moulded plastics body portion of the switch defines a closed chamber which accommodates the bimetallic actuator, the first and second terminal conductors are moulded into the body portion of the switch at spaced-apart locations so as to have exposed portions spaced-apart from each other within said chamber and externally of the body portion, the bimetallic actuator is directly welded to the exposed portion of said one of said conductors within the chamber, and the contact carried by the bimetallic actuator co-operates directly with the exposed portion of the other of the two conductors within the chamber.

The bimetallic actuator of the switch is advantageously of such low thickness as to be responsive to through current as low as 2 amps or less without requiring provision of a supplementary heat source, for example a bimetallic element of the order of 0,076 mm (0.003 inch) thickness, and the switch body part preferably provides physical support for the bimetallic element during switching operations.

In an exemplary embodiment which will be described in detail hereinafter the bimetallic actuator is of a kind having a generally U-shaped cut-out defining a tongue between spaced apart leg portions which are bridged adjacent the free end of the tongue. The terminal conductors are formed as simple wires and the tongue of the bimetal is secured to one of the terminal conductors by welding, and the bridging portion carries the contact which co-operates with the other conductor. No discrete contact is provided on the other conductor which however comprises a silver or silver alloy coating, for example a silver antimony coating as described in PCT/GB 92/00185. The moulded plastics body portion of the switch defines an enclosure for the bimetallic actuator and, as will hereinafter be described, also incorporates portions which provide structural support for the bimetal. The resultant switch is of simple and easily manufactured construction which enables small size to be achieved for enhanced sensitivity to very low overload currents.

To enhance the current sensitivity of the switch, a series-connected heating element may be provided for injecting heat into the bimetallic actuator when the switch is in closed condition, and in a particularly convenient arrangement the heating element may be constituted by a portion of one or the other or both of the two terminal conductors of the switch which is formed as a resistance heating element. Such an arrangement would obtain a more rapid switch response to a current overload situation than would be obtained if the heating element were not provided. In an alternative arrangement, a high resistance heating element could be provided in parallel with the switch conductors, for example in the form of a conductive ink printed on the switch body portion, the effect of such an arrangement being to inhibit resetting of the switch until such time as the power supply to and through the switch was switched off thereby permitting the bimetallic actuator to cool so as to reset the switch.

The above and further features of the invention are set forth with particularity in the appended claims and will best be appreciated from consideration of the following detailed description of an exemplary embodiment given with reference to the accompanying drawings.

DETAILED DESCRIPTION OF THE EMBODIMENT

Figure 1:
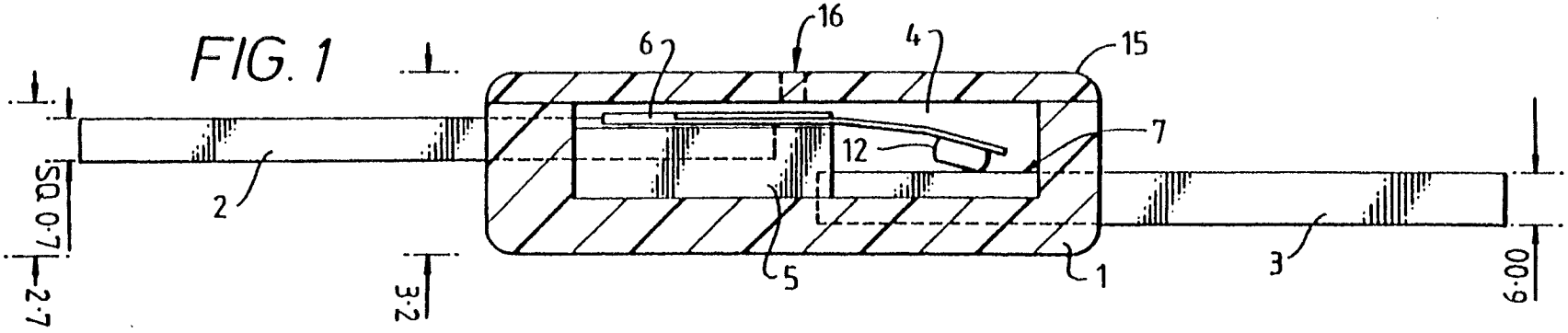
FIG. 1 is a sectional side elevation view of the subject switch on the line I . . . I in FIG. 2.

The views in the drawings show the switch to an enlarged scale and the dimensions indicated are the actual dimensions of the switch in millimeters. The moulded plastics body portion 1 of the switch is thus generally rectangular with dimensions of 10.5 mm×6.0 mm ×2.7 mm and the terminal conductors 2, 3 project outwardly by a further 7.0 mm. A top cover for the switch has a thickness of 0.5 mm. The switch thus has such small overall size that it may conveniently be supplied in a bandolier suitable for use by automatic component insertion equipment.

Within the body portion 1 of the switch there is defined a chamber 4 which has dimensions of the order of 8.0 mm×5.0 mm×1.7 mm, and an upstand 5 occupies part of this chamber. A simple copper wire conductor 2 has a square or rectangular section and is moulded into the body portion 1 at one end thereof with its forward part received in a recess in the upper surface of the upstand 5, and a simple copper wire conductor 3 has a circular section, though it too could have a square or rectangular section, and is moulded into the opposite end of the body portion 1 so as to be exposed at 7 within the chamber 4. A bimetallic actuator 6 is welded to the forward part of conductor 2. The portion 7 of conductor 3 constitutes a switching contact of the subject switch and accordingly conductor 3 is preferably formed of silver plated copper wire or more preferably silver-antimony plated copper wire in accordance with the teachings of our International Patent Application No. PCT/GB 92/00185; conductor 2 may be similarly formed though this is not essential.

In accordance with the teachings of International Patent Application No. PCT/GB 92/00185 abovementioned, a preferred form of conductor wire providing excellent electrical characteristics in combination with superior wear characteristics comprises a copper wire, or a wire formed from a copper alloy having a thermal conductivity at least 90% that of copper, and more preferably 95% to 99% that of 99.95% pure copper, provided with a thick plating layer of silver and antimony, and the conductor wire 3 above-described can advantageously have this construction. By the use of a thick plating (e.g. at least 30 microns and preferably 40 microns thickness) comprising fine silver (99.9% purity) with a small amount of antimony, typically about 1% and particularly between 0.3% and 0.7%, on a conductor formed of copper or a high thermal conductivity copper alloy, the formation of silver powder during switching operations is inhibited and a life of about 70,000 switching cycles may be obtained.

Bimetallic actuator 6 is of the Otter Controls type comprising a dished blade of bimetallic material having a generally U-shaped cut-out 8 which defines a tongue 9 between legs 10 which are bridged by a bridging portion 11. The moving contact of the switch is constituted by a silver contact 12 welded to the underside of bridging portion 11 as best shown in FIG. 1. The actuator 6 is secured to terminal conductor 2 by virtue of the tongue 9 being welded thereto. The shape of the bimetallic blade is such as to enhance its responsiveness to through currents by increasing the current density in the legs 10 and in the contact-carrying forward region of the blade.

The upstand 5 provides support for the forward portion of conductor 2 which in turn provides support for tongue portion 9 of bimetallic actuator 6, whereas the legs 10 and bridging portion 11 of the bimetal 6 are free to move within the chamber 4. By virtue of this arrangement, the temperature responsive characteristics of the switch can better be predetermined since switching operations are effected substantially exclusively by flexure of the legs 10 about the stable position established for tongue 9 by virtue of its support on conductor 2. Furthermore, by supporting the tongue 9 in this way, the risk of stress cracking at the root of the tongue is reduced and the working stresses in the bimetal are concentrated towards its elongate legs 10.

In operation of the switch as thus described, contact 12 will, move away from portion 7 of conductor 3, with a snap-action, whenever the temperature of the bimetal 6 rises to a certain predetermined level, either as a result of thermal conduction from the switch environment, or as a result of heating of the bimetal by current flow therethrough, or as combination of these two effects. When the bimetal cools sufficiently the switch will remake.

The closure 15 may conveniently be moulded as an integral part of the switch body which is hingedly coupled thereto and is ultrasonically welded shut after assembly of the bimetal 6 into the chamber 4 and spot welding of the tongue 9 to the forward part of conductor 2. The closure 15 may be formed so as to isolate the chamber 4 from the environment of the switch, or may alternatively be provided with one or more openings 16 as indicated.

The bimetallic material of the actuator 6 has a thickness of only 0.076 mm (0.003 inch) and insofar as we are aware no previous bimetallic switch incorporating a dished snap-acting bimetallic actuator of the Otter Controls type has employed bimetallic material of such low thickness. Indeed, the material used in the described switch had to be specially manufactured for us. By use of such a thin bimetallic material in a switch construction where the switch body provides support to the bimetal we have been able to obtain repeatable switch action for low current switching below 2 amps. In previously known bimetallic switches the thickness of the bimetal has been such that insufficient self-heating of the bimetal was obtained to cause them to operate with through currents as low as 2 amps, and it has been necessary with such conventional switches to provide a separate heater, sometimes in the form of a thick film resistor, to pump heat into the bimetal in order to cause it to switch. Such provisions are generally disadvantageous from considerations of cost and power drain, can provide undesirably low open circuit resistance and may have undesirable consequences if the device is faulty. The switch described in the foregoing overcomes all of these problems.

Figure 2:
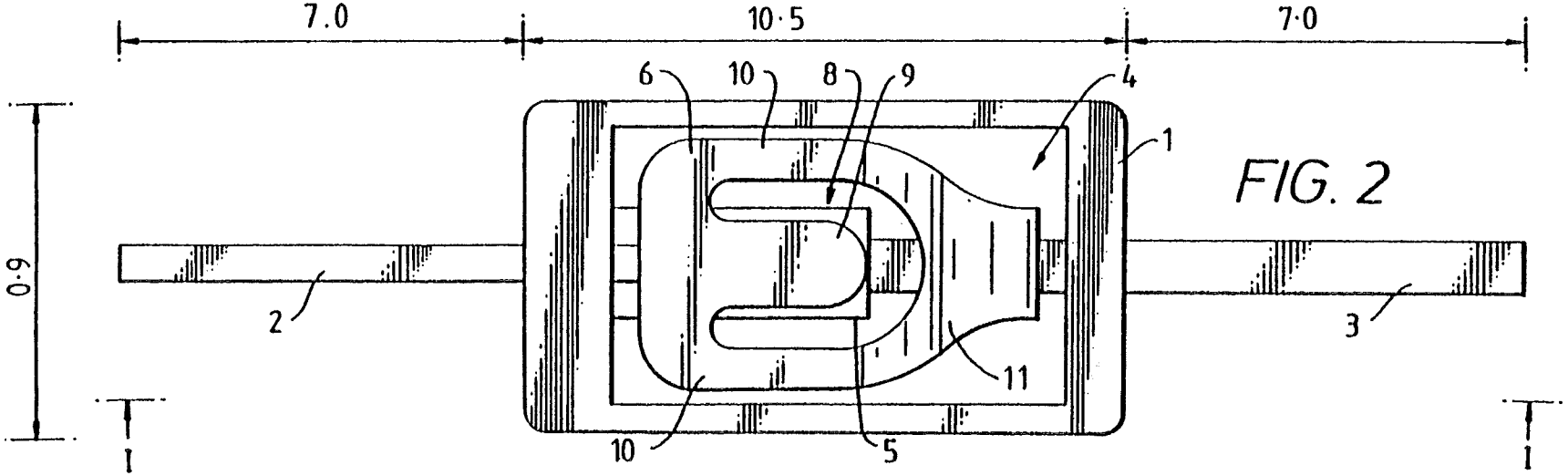
FIG. 2 is a plan view showing the switch of FIG. 1 with its top cover removed.
Figure 3:
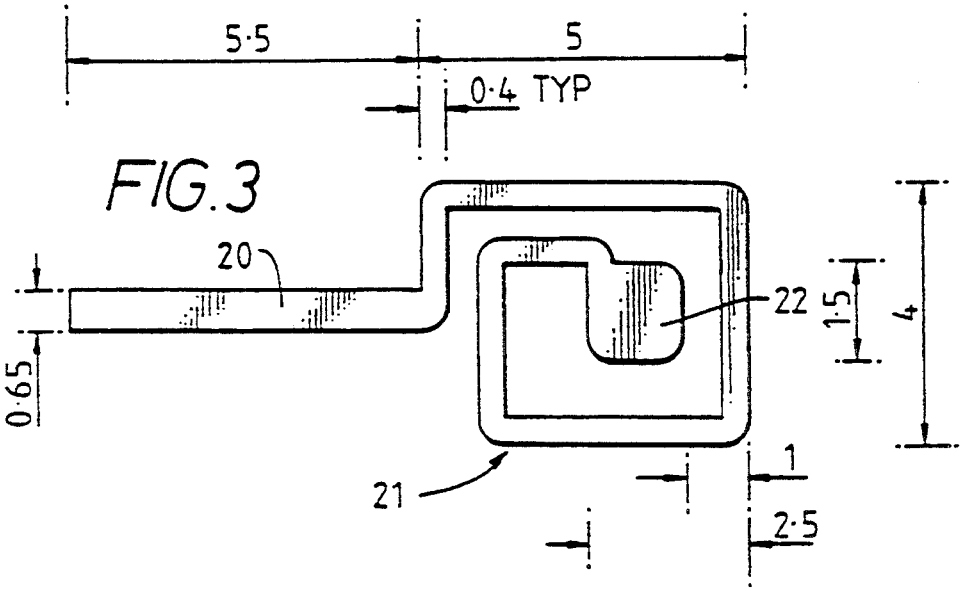
FIG. 3 shows an alternative conductor construction which could be employed in the switch of FIG. 1 so as to provide a heater within the switch.

Notwithstanding the potential difficulties that are associated with the provision of heaters in switches as abovementioned, for certain switch applications the provision of a heater may be desirable and the switch described in the foregoing could readily be modified to incorporate a heater. FIG. 3 shows an alternative form of conductor which could be used in the switch of FIGS. 1 and 2 in place of the conductor 2. As shown in FIG. 3, conductor 20 is formed of a resistance heating material and has a forward portion 21 which is adapted to be received within the switch body chamber 4 and is formed generally as a spiral terminating in a pad 22 to which the tongue 9 of the bimetal actuator 6 is spot welded. The dimensions shown in FIG. 3 are in millimeters, FIG. 3 being an enlarged showing of the conductor.

The described switch is well suited to automatic manufacture and installation, comprises a minimum of parts and can be relatively inexpensive, and is capable of miniaturisation for enhanced current sensitivity. The switch is, however, but an example of what is achievable by virtue of the invention and modifications and variations are possible without departure from the spirit and scope of the invention. For example, the bimetal could be pear-shaped as described in GB 2124429 aforementioned for enhanced current sensitivity, or could take a variety of alternative shapes.

We claim:

1. A thermally-responsive switch comprising a molded plastic body portion capturing therein first and second terminal conductors, and a snap-acting bimetallic actuator secured to one of said conductors and carrying a contact which constitutes a moving contact of the switch and is arranged for cooperation in switching operations with the other of the two conductors which constitutes a fixed contact of the switch, and wherein the molded plastic body portion of the switch defines a chamber which accommodates the bimetallic actuator, the first and second terminal conductors are molded into the body portion of the switch at spaced-apart opposite ends thereof so as to have exposed portions spaced apart from each other at opposite ends of the body portion of the switch, both within said chamber and externally of the body portion, the bimetallic actuator is directly welded to the exposed portion of said one of said conductors within the chamber, the contact carried by the bimetallic actuator cooperates directly with the exposed portion of the other of the two conductors within the chamber, the bimetallic actuator comprises a dished bimetallic blade having a generally U-shaped cut-out defining a central tongue extending between a pair of external legs which are bridged by a bridging portion adjacent the tip of the tongue, and the tongue of the bimetallic blade is secured to said one of the conductors and the contact is carried by the bridging portion, and the molded plastic body portion defines an upstand within said chamber and the upstand provides support for the exposed portion of said one of said conductors within the chamber which, in turn, provides support for the tongue of the bimetallic blade, whereas the legs of the bimetallic blade and the bridging portion are free to move within the chamber.

2. A switch as claimed in claim 1, wherein the first and second terminal conductors comprise simple conductive wire conductors.

3. A switch as claimed in claim 1 or 2, wherein that portion of said other of the two conductors which cooperates in switching operations with the contact carried by the bimetallic actuator includes a layer comprising silver.

4. A switch as claimed in claim 3, wherein at least said other of the two conductors comprises copper, or a copper alloy having a thermal conductivity at least 90% the thermal conductivity of copper, with a plating layer of silver containing antimony.

5. A switch as claimed in claim 4, wherein the plating layer is at least 30 microns thick and contains about 1% antimony.

6. A switch as claimed in claim 1, wherein said contact comprises silver.

7. A switch as claimed in claim 1, wherein that one of the conductors to which the bimetallic actuator is secured has a square or rectangular section and the tongue of the bimetallic blade is welded to a flat surface of the conductor.

8. A switch as claimed in claim 1, wherein the bimetallic blade has a thickness of 0.076 mm.

9. A switch as claimed in claim 1, wherein the molded plastic body portion of the switch is generally rectangular and defines a generally rectangular chamber having dimensions of the order of 8.0 mm×5.00 mm×1.7 mm.

10. A switch as claimed in claim 1, wherein at least one of said conductors comprises a resistance heating portion adapted to pump heat into the bimetallic actuator.

11. A switch as claimed in claim 1, wherein a resistance heating element is provided in parallel with the switch conductors.

12. A switch as claimed in claim 1, wherein the molded plastic body portion is such as to isolate said chamber from the environment of the switch.

13. A thermally-responsive switch comprising a molded plastic body portion capturing therein first and second terminal conductors, and a snap-acting bimetallic actuator secured to one of said conductors and carrying a contact which constitutes a moving contact of the switch and is arranged for cooperation in switching operations with the other of the two conductors which constitutes a fixed contact of the switch, and wherein the molded plastic body portion of the switch defines a chamber which accommodates the bimetallic actuator, the first and second terminal conductors are simple conductive wire conductors which are molded into the body portion of the switch at spaced-apart opposite ends thereof so as to have exposed portions spaced apart from each other at opposite ends of the body portion of the switch, both within said chamber and externally of the body portion, the bimetallic actuator is directly welded to the exposed portion of said one of said conductors within the chamber, and the contact carried by the bimetallic actuator cooperates directly with the exposed portion of the other of the two conductors within the chamber.

14. A switch as claimed in claim 13, wherein said contact comprises silver and that portion of said other of the two conductors which cooperates in switching operations with the contact carried by the bimetallic actuator includes a layer comprising silver.

15. A switch as claimed in claim 14, wherein said other of the two conductors comprises copper or a copper alloy having a thermal conductivity at least 90% that of copper, and said portion thereof which cooperates with said contact has a plating layer of silver containing antimony.

16. A switch as claimed in claim 15, wherein the plating layer is at least 30 microns thick and contains about 1% antimony.

17. A switch as claimed in claim 13, wherein that one of the conductors to which the bimetal is secured has a square or rectangular section and the bimetal is welded to a flair surface of the conductor.

18. A switch as claimed in claim 13, wherein at least one of said conductors comprises a resistance heating portion adapted to pump heat into the bimetallic actuator.

19. A switch as claimed in claim 13, wherein a resistance heating element is provided in parallel with the switch conductors.

20. A switch as claimed in claim 13, wherein the molded plastic body portion is such as to isolate said chamber from the environment of the switch.

* * * * *